United States Patent [19]

Nozawa et al.

[11] 4,417,568

[45] Nov. 29, 1983

[54] AIR BUBBLE GENERATING APPARATUS FOR USE IN BATHTUB

[75] Inventors: Nobuyuki Nozawa; Toshio Mikiya, both of Tokyo, Japan

[73] Assignee: Nitto Kohki Co., Ltd., Tokyo, Japan

[21] Appl. No.: 288,932

[22] Filed: Jul. 31, 1981

[30] Foreign Application Priority Data

Aug. 1, 1980 [JP] Japan ..... 55-108314[U]

[51] Int. Cl.[3] ..... B01F 3/04

[52] U.S. Cl. ..... 128/33; 4/543; 128/66

[58] Field of Search ..... 128/32, 33, 24, 38, 128/64, 65; 4/541, 542, 543

[56] References Cited

U.S. PATENT DOCUMENTS

| | | | |
|---|---|---|---|
| 1,350,974 | 8/1920 | Kolshorn | 4/543 |
| 1,699,198 | 1/1929 | Millmather | 4/543 |
| 2,856,611 | 10/1958 | Velonis | 4/543 |
| 4,290,982 | 9/1981 | Bauman | 4/542 |

FOREIGN PATENT DOCUMENTS

| | | | |
|---|---|---|---|
| 827391 | 7/1949 | Fed. Rep. of Germany | 4/542 |
| 1491560 | 4/1970 | Fed. Rep. of Germany | 4/542 |
| 2912006 | 10/1980 | Fed. Rep. of Germany | 4/541 |
| 2919313 | 11/1980 | Fed. Rep. of Germany | 4/543 |

*Primary Examiner*—Richard J. Apley
*Assistant Examiner*—David J. Brown
*Attorney, Agent, or Firm*—Wenderoth, Lind & Ponack

[57] ABSTRACT

An air bubble generating apparatus for use in a bathtub filled with hot water, which has two air bubble generating boards inside which spacers and central air passages are provided and which are capable of being bent at the middle portion thereof. A large number of air bubbles are genertaed by supplying compressed air into the air bubble generating boards with the apparatus disposed with one of the boards is positioned along the bottom of the bathtub and the other board along the side wall thereof, consequently to bring about a considerable massaging effect on the whole body of a subject.

11 Claims, 9 Drawing Figures

AIR BUBBLE GENERATING APPARATUS FOR USE IN BATHTUB

BACKGROUND OF THE INVENTION

This invention relates to an air bubble generating apparatus which is used in the bent state in a bathtub filled with hot water to generate air bubbles by supplying compressed air to the apparatus thereby bringing about a massaging effect on the whole body of a subject for beauty or remedial purpose by the action of air bubbles.

As is well-known, it is good for beauty and health to expose the body and limbs of a subject to fine air bubbles in a bathtub filled with hot water. As an example, the apparatus of the type used for this purpose, is constituted by tubes with a plurality of pores integrally disposed on the bottom of the bathtub for generating air bubbles when compressed air is supplied to the tubes, has been developed in the past. (U.S. Pat. No. 3,251,071)

Among others, there has been proposed a disc-shaped air bubble generating apparatus which comprises an air chamber and an upper panel with a large number of pores which generates air bubbles when compressed air is supplied to the air chamber when it is sunk to the bottom of the bathtub and a subject sits down on the apparatus. (Refer to U.S. Pat. Nos. 3,299,885 and 3,809,073, for example)

These well-known bubbling apparatuses, however, generate air bubbles only from a part on which the subject sits down and have little massaging effect on the upper half of the subject's body, and since the conventional apparatuses are constructed without regard to uniformity of the air bubbles generated from the whole surface of the apparatus, a massaging action is effectively given only to a limited part of the subject's body. Besides, the conventional apparatus has limited durability, because water which has accidentally entered the air chamber of the apparatus through the pores bored in the upper panel thereof, cannot be thoroughly removed from the air chamber. Generally, in the conventional bubbling apparatus, since compressed air is supplied at one end portion of the apparatus, air bubbles cannot be generated uniformly over the whole of the apparatus, thereby reducing effectiveness of the massaging action. Particularly, the former apparatus wherein tubes with a plurality of pores are integrally fixed on the bottom of a bathtub, is inevitably priced high and requires troublesome maintanance. The latter apparatus which is separate from the bathtub suffers the disadvantage that it is awkward to store and has an unwieldy bulk when not in use.

SUMMARY OF THE INVENTION

In view of the state of affairs described above, an object of the present invention is to provide an air bubble generating apparatus which effectively and uniformly generates air bubbles from not only a portion on which a subject sits down but a portion against which the subject leans his back, permits water to be readily removed even when it enters the interior of the apparatus, and is convenient for storage and handy to carry.

To acccomplish the object described above according to the present invention, there is provided an air bubble generating apparatus which comprises at least one bubble generating board flexibly bendable at its middle portion and composed of an upper panel having a large number of pores and a lower panel to be united with the upper panel to form an air chamber between the upper and lower panels, and an air supplying member connected to the middle side portion of the air bubble generating board, thereby to permit compressed air to be introduced into the air bubble generating board and to be distributed uniformly over the whole of the air bubble generating board.

An air passage may be provided in the air chamber defined by the upper and lower surfaces in the longitudinal direction of the bubble generating board and a plurality of spacers may be formed on the lower surface of the upper panel, whereby the compressed air introduced into the air chamber can be spread uniformly over the whole of the air bubble generating board by means of a distributing means constituted by the air passage and the spacers to generate air bubbles uniformly from the entire surface of the air bubble generating board.

When the apparatus is composed of a pair of air bubble generating boards, the air supplying member and a drain member may be used as means for connecting the air bubble generating boards to each other. In this case, since the air bubble generating boards can be double folded by using the air supplying and drain members as hinge means, the size of the air bubble generating apparatus at the time that it is not in use can be reduced to make it handy to carry and much easier to store.

The other object and characteristic features of the present invention will become apparent from the further disclosure of the invention made hereinafter with reference to the accompanying drawings.

DESCRIPTION OF THE PREFERRED EMBODIMENTS

Figure 1:
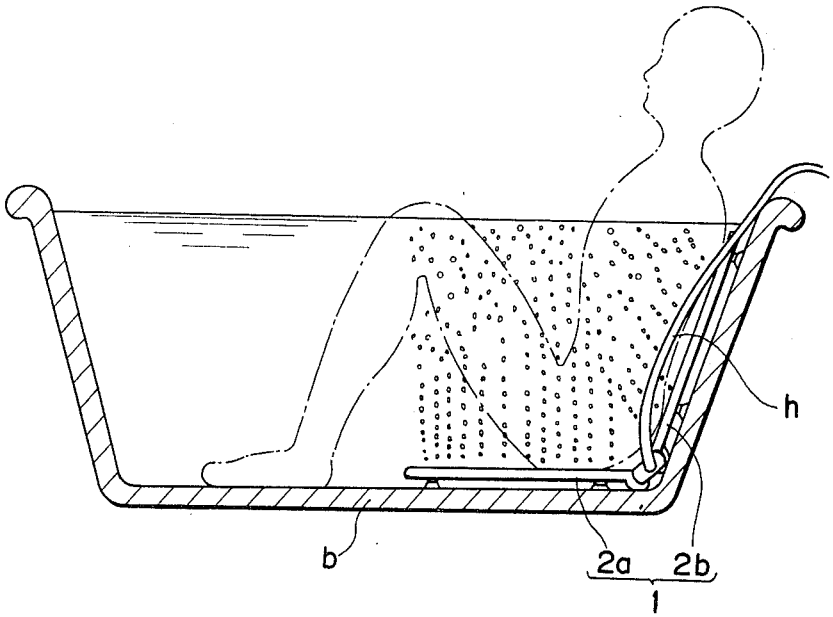
FIG. 1 is a schematic diagram of the air bubble generating apparatus of the present invention, in the state of use.

The present invention relates to an air bubble generating apparatus which generates air bubbles by supplying compressed air to the apparatus in such a state that the apparatus is sunk to the bottom of a bathtub, thereby giving massaging and cleansing actions to the whole body of a subject, and more particularly, generates air bubbles uniformly over the apparatus even when the apparatus 1 is bent along the bottom and the side wall of the bathtab b as illustrated in FIG. 1, to heighten the massaging effect thereof.

Figure 2:
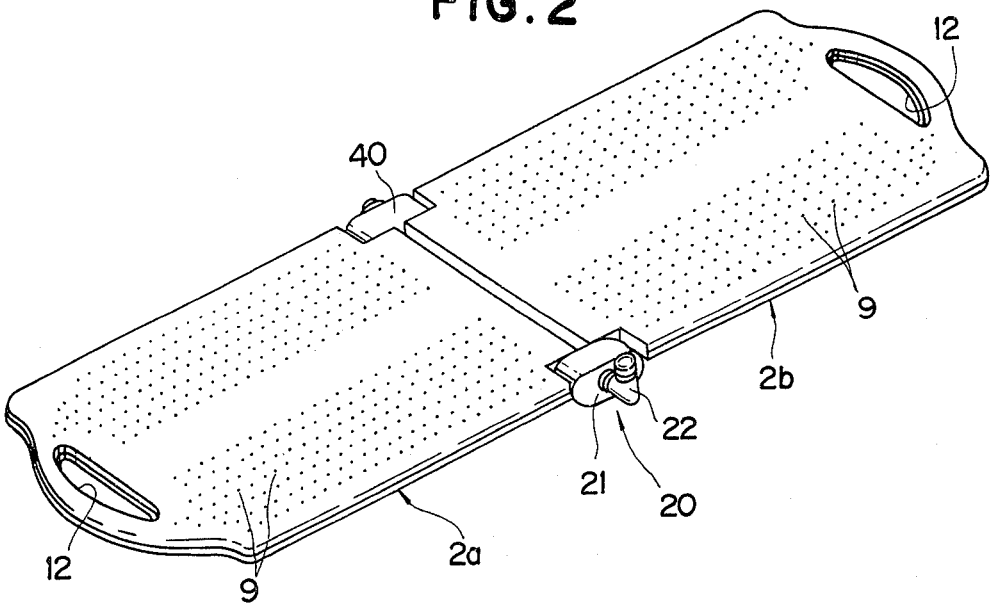
FIG. 2 is a perspective view of one preferred embodiment of the air bubble generating apparatus of the present invention.
Figure 3:
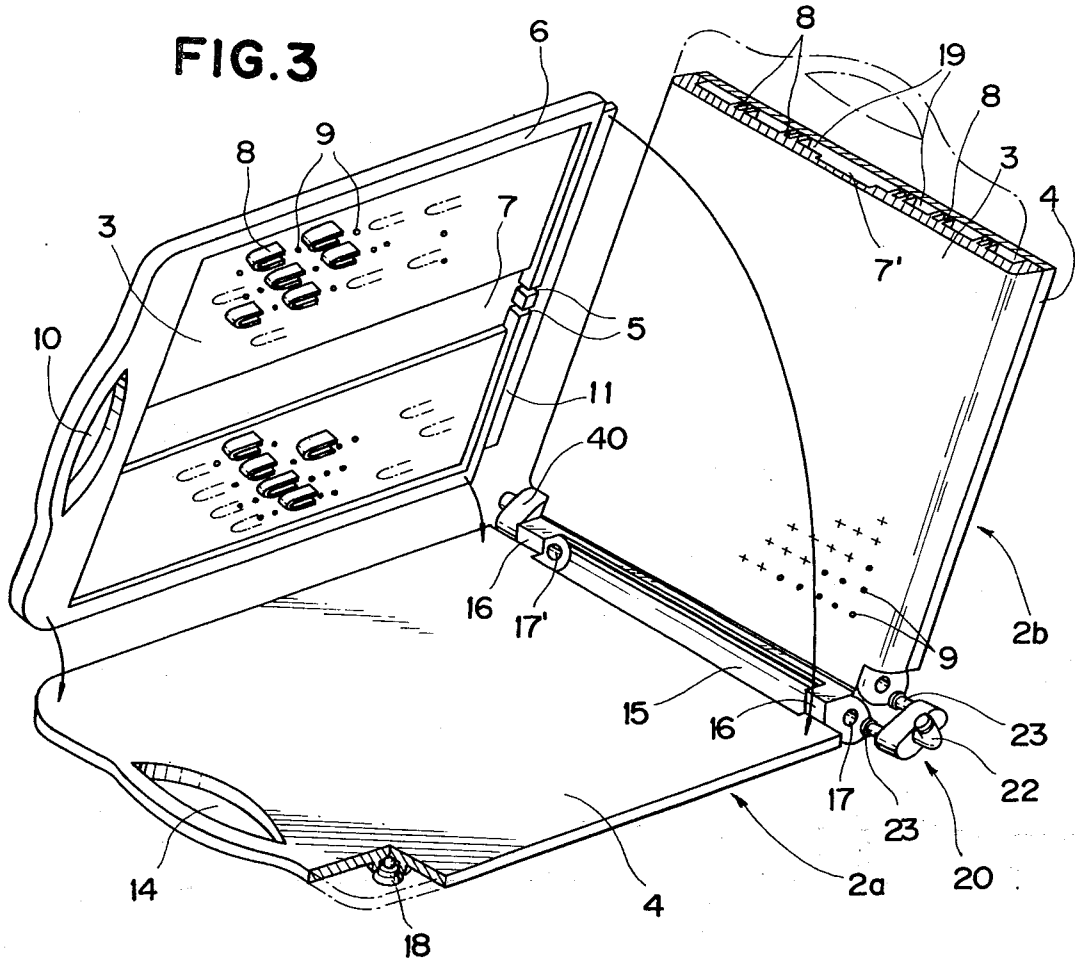
FIG. 3 shows, partially in section, an exploded view of the same.

In FIG. 2 and FIG. 3 is illustrated the air bubble generating apparatus according to one preferred embodiment of the present invention. By *2a* and *2b* are denoted a pair of separate air bubble generating boards each composed of an upper panel 3 and a lower panel 4. The upper panel 3 is, as illustrated in FIG. 3, possessed of, on the peripheral portion of its lower surface, a raised wall 6 having at least one slit 5, and on the middle portion of the lower surface thereof, a groove 7 extending in the longitudinal direction thereof. Further, on the upper panel 3, a plurality of U-shaped spacers 8 and a large number of pores 9 are arranged at regular intervals on the portion surrounded by the raised wall 6 other than the groove 7. On one extreme portion of the respective upper panel 3, a handle opening 10 is bored, and from the other extreme portion thereof, a cover plate 11 extends.

Each lower panel 4 to be united with the upper panel 3 is provided on one extreme portion thereof with a handle opening 14 corresponding to the handle opening 10 in the upper panel 3 so as to form a handle grip 12 the upper and lower panels are united with each other and on the other extreme portion thereof, an air retaining space 15 the end walls 16 of which have through holes 17 and 17' through which the space 15 is communicated with the exterior thereof. The air retaining space 15, the spacers 8, the groove 7 and the slits 5 provided in each air bubble generating board constitute an air distributing means in this embodiment.

Figure 4:
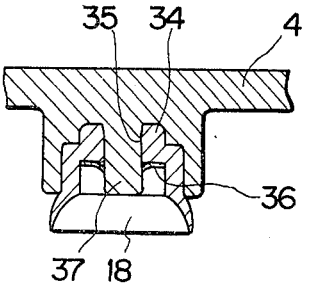
FIG. 4 is an enlarged view in section of the suction member mounted on the lower surface of the air bubble generating apparatus according to the present invention.

Some suction members 18 are snapped into engagement with the lower surface of the respective lower panel 4. As illustrated in FIG. 4, each suction member 18 is composed of a clamp portion 34 which is provided with a central hole 35 and a retaining claw piece 36 having a hole coinciding with the central hole 35. On the other hand, the lower panel 4 is provided on its lower surface with projections 37 equal in diameter to the corresponding central hole 35 of the suction member 18. When the suction member 18 is engaged with the projection 37 on the lower panel 4 in such a manner that the projection 37 is inserted into the central hole 35, the suction member 18 cannot readily be withdrawn from the projection 37 because of the retaining claw piece 36.

Figure 5:
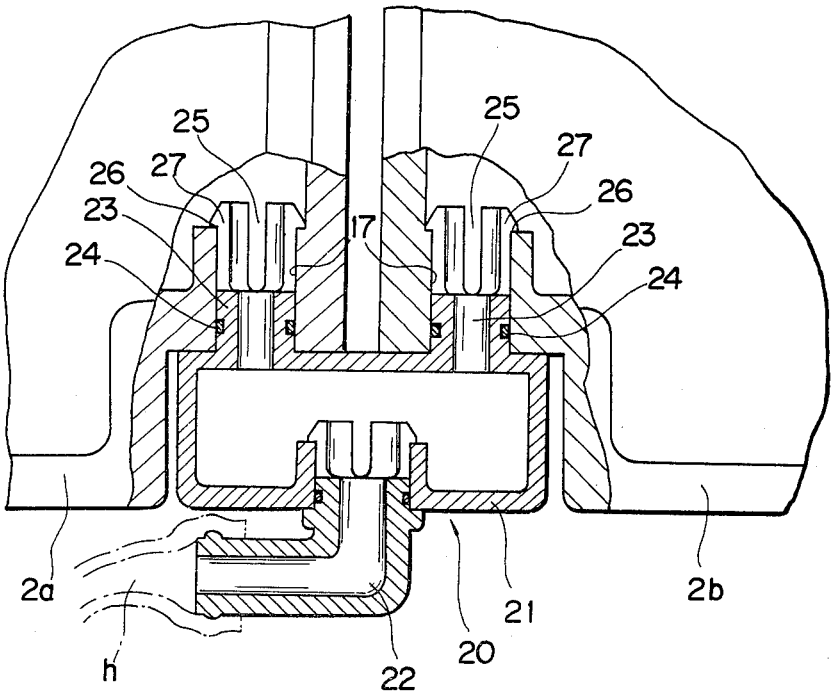
FIG. 5 is an enlarged sectional plan view of the air supplying member in the air bubble generating apparatus of the present invention.

By 20 is denoted an air supplying member having the function of rotatably connecting the air bubble generating boards *2a* and *2b* with each other. The air supplying member 20 is, as illustrated in FIG. 5, composed of a hollow base portion 21, an L-shaped conduit pipe 22 which is rotatably fastened to one side of the hollow base portion 21 by a snap action means and a pair of axial nozzles 23 provided on the other side of the hollow base portion 21 and spaced at a distance from each other and rotatably inserted into the holes 17. The inner end of pipe 22 and axial nozzles 23 are provided on their peripheral surface with sealing rings 24, at their end portion with slots 25 extending in the longitudinal direction thereof, and on their peripheral surfaces with engaging members 27 having engaging claws 26 and constituting snap action means.

Figure 6:
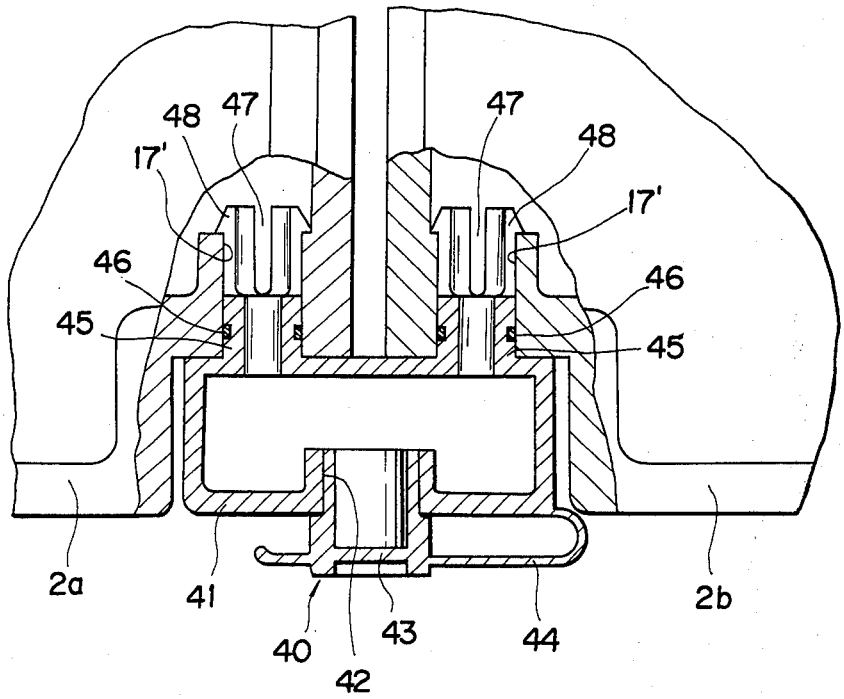
FIG. 6 is an enlarged sectional plan view of the drain member in the air bubble generating apparatus of the present invention.

40 denotes a drain member which comprises a hollow base portion 41 with a drain hole 42 and a tap member 43 which is fastened to the hollow base portion 41 by means of a flexible strap member 44 and adapted to be detachably fitted into the drain hole 42, as illustrated in FIG. 6. The other construction of the drain member 40 is fundamentally similar to that of the air supplying member 20 as illustrated in FIG. 5. In brief, a pair of axial nozzles 45 are integrally mounted on one side of the hollow base portion 41 at fixed intervals and provided on their peripheral surfaces with sealing rings 46 and engaging members 49 with engaging claws 48, and with slots 47 extending in the longitudinal direction thereof and are rotatably inserted into holes 17'.

The operation of the above described apparatus according to the present invention will be explained hereinafter.

In each air bubble generating board, the upper panel 3 and the lower panel 4 are united with each other to form a closed board by attaching the raised wall 6 provided on the peripheral portion of the upper panel 3 to the peripheral portion of the lower panel 4 and attaching the U-shaped spacers 8 to the upper surface of the lower panel 4 so that the cover plate 11 closes the air retainer space 15, thus to form an interior air chamber 19 which is interconnected with the air retaining space 15 through the slits 5. The air chamber 19 has the central air passage 7' formed by the groove 7. A pair of air bubble generating boards *2a* and *2b* thus constructed by the upper and lower panels 3 and 4 are rotatably connected with each other by means of the air supplying member 20 and the drain member 40 which are used as a hinge means. The union of the two boards *2a* and *2b* is accomplished by inserting the respective axial nozzles of the air supplying member 20 and the drain member 40 into the corresponding through holes 17 and 17' bored in the end walls 16 of the air retaining space 15 and then, engaging, by a snap action, the claws 26 and 48 disposed on the outer periphery of the respective engaging members 27 and 49 of the air supplying member 20 and the drain member 40 with the inner edges of the through holes 17 and 17' bored in the end walls of the air retaining space 15. In such an assembled state, when compressed air produced by a compressor, for example, is introduced into the air retaining space 15 through the L-shaped conduit pipe 22 and the hose h, the compressed air is equally divided into two streams by the air supplying member 20 and then advances toward the terminal portions of the central passages 7' within the air bubble generating boards *2a* and *2b* through the slits 5. Thereafter, the air introduced into the air chamber 19 of each air bubble generating board is dispersed by the spacers 18 and discharged as a large number of air bubbles into water in the bathtub via the pores 9 bored in the upper panel 3 of the air bubble generating board.

By rotatably connecting the air bubble generating boards *2a* and *2b* with each other, the boards *2a* and *2b* may be used in the folded state in the bathtab with one of the boards positioned along the bottom of the bathtub and the other board along the side wall thereof as illustrated in FIG. 1 thereby allowing not only the lower half but the upper half of the subject to be effectively exposed to a large number of air bubbles, and further the boards *2a* and *2b* can be folded double when not in use so as to make storage easy.

When the air bubble generating board *2b* is used in an upright position along the side wall of the bathtub as illustrated in FIG. 1, the amount of air bubbles released from the board *2b* is increased so as to bring about a considerable massaging effect on the upper half, particularly the shoulder and back, of the subject, while the air bubbles released from the portion of the board *2a* in the vicinity of the joining portion of the boards 2a and 2b massage his waist and back and the air bubbles released from the other portion of the board 2a massage his buttocks and femoral region.

The suction members 18 which are detachably snapped into engagement with the lower surface of the air bubble generating boards 2a and 2b perform the function of fixing the boards temporarily on the inner surface of the bathtub, and may be detached as occasion demands.

Figure 7:
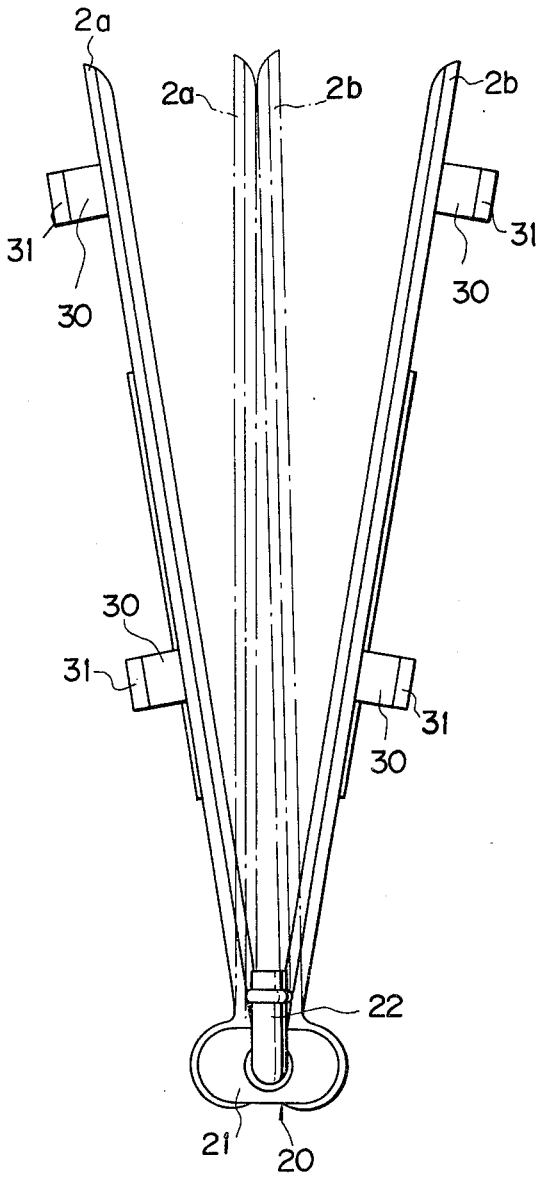
FIG. 7 is a front view of the air bubble generating apparatus with a partial modification, in the folded state, according to the present invention.
Figure 8:
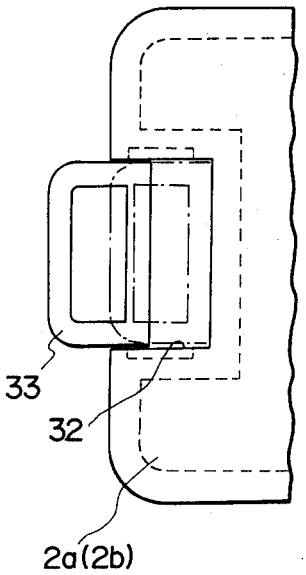
FIG. 8 is a sectional view of the handle grip of another embodiment according to the present invention.

As described above, according to the present invention, a large number of air bubbles can be released from the whole of the perforated surface of the air bubble generating boards 2a and 2b thereby to bring about a massaging effect upon the whole body of the subject in a seating position in the bathtub by the action of the air bubbles, because the compressed air introduced into the air retaining space 15 of each air bubble generating board is forwarded to the central air passage 7' through the slits 5 and spreads uniformly through the air chamber 19 within the board with the aid of the distributing means constituted by the spacers 8 and the central air passage 7'. Even when water accidentally flows into the interior of the air bubble generating boards, it can easily be drained off by tilting the folded boards 2a and 2b while removing the tap member 43 from the drain hole 42 of the drain member 40 and placing the drain member 40 down. The effective drainage of water is fulfilled by means of spacers 8 shaped in the form of a U and opened toward the air retaining spaces 15 thereby preventing a lowering of efficiency due to water remaining within the boards 2a and 2b. Since the air bubble generating boards 2a and 2b are rotatably joined with each other by means of the air supplying member 20 and the drain member 40, the boards 2a and 2b may be secured in position one along the bottom of the bathtub and the other along the side wall thereof, so that the subject is exposed to a large number of air bubbles with a marked effect. Also, since the boards 2a and 2b are rotatably supported by two pairs of axial nozzles of the air supplying member 20 and the drain member 40, they stand stably on the members 20 and 40 when folded as illustrated in FIG. 7, making it convenient to store the apparatus away when it is not in use. Besides, since the air supplying member 20 and the drain member 40 are attached to the air bubble generating boards 2a and 2b by a snap action means, the present apparatus can be assembled by a simple operation. Further, the air bubble generating boards 2a and 2b can temporarily be fixed on the bottom and the side wall of the bathtub by means of the suction members 18 which are snapped into engagement with the lower surfaces of the boards 2a and 2b and consequently, even when the subject gets out of the bathtub, the boards 2a and 2b are held against rising vigorously to the surface of the water in the bathtub. As illustrated in FIG. 7, in place of the aforesaid suction members 18, rubber dampers 31 may be disposed at the extremity of supporters 30 fixed on the lower surface of the respective air bubble generating boards. The handle grip 12 is provided at the exteme portion of each board to facilitate conveyance of the apparatus. The handle grip may be constructed by providing a cutaway 32 at the extreme portion of each of the boards 2a and 2b and slidably mounting a separate grip 33 member in the cutaway 32 as illustrated in FIG. 8.

Figure 9:
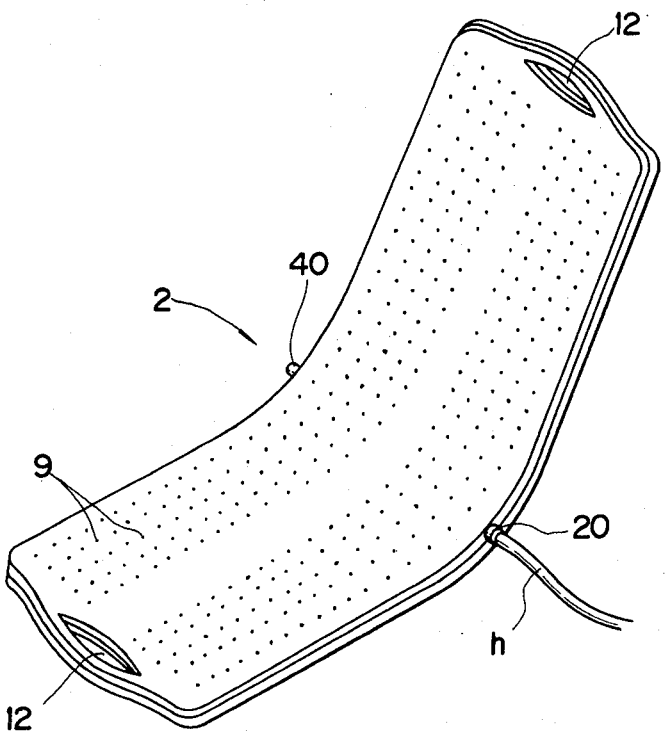
FIG. 9 is a perspective view of still another embodiment according to the present invention.

Although, in the aforesaid embodiment, the air bubble generating apparatus is composed of a pair of boards 2a and 2b, it may, of course, be constituted by a single air bubble generating board 2 flexibly bendable at the middle portion thereof as illustrated in FIG. 9. In this case, a hose h may be detachably connected with the board 2 at one side of the bendable portion of the board thereby obtaining the same function and effect as in the aforesaid embodiment.

What is claimed is:

1. An air bubble generating apparatus for use in a body of hot water such as a bathtub or the like, and comprising:

a pair of hollow air bubble generating boards each having an upper surface with a large number of bubble openings therein, said boards each having an edge in spaced opposed relationship to the corresponding edge of the other board and with the upper surfaces facing in the same direction; and an air supplying member rotatably connected to said air bubble generating boards at said spaced opposed edges for hinging said boards to each other for folding about an axis along said spaced opposed edges, said air supply member having means for receiving air from an air source and supplying the air into the hollow interior of each of said air bubble generating boards.

2. An air bubble generating apparatus as claimed in claim 1 in which said air supplying means comprises two air supplying nozzles rotatably inserted through the respective boards into the hollow interiors thereof for rotatably connecting said boards to said air supplying member.

3. An air bubble generating apparatus as claimed in claim 2 in which said air supplying nozzles are spaced from each other in the direction of the spacing of said edges of said boards and extending parallel to said axis and rotatably inserted through the respective boards at one end of said edges and into the hollow interiors thereof for rotatably connecting said boards to said air supplying member.

4. An air bubble generating apparatus as claimed in claim 2 in which said air supplying member is at one of the ends of said spaced opposed edges, and said apparatus further comprises a drain member rotatably connected to said air generating boards at the other of the ends of said spaced opposed edges for hinging said boards to each other for folding about said axis, said drain member having two drain nozzles rotatably inserted through the respective boards into the hollow interiors thereof for rotatably connecting the boards to said drain member.

5. An air bubble generating apparatus as claimed in claim 4 in which said two drain nozzles are spaced from each other in the direction of the spacing of said edges of said boards and extending parallel to said axis and rotatably inserted through the respective boards at said other end of said boards into the hollow interiors thereof for rotatably connecting said boards to said drain member.

6. An air bubble generating apparatus as claimed in claim 1 in which said air supplying member is at one of the ends of said spaced opposed edges, and said apparatus further comprises a drain member rotatably connected to said air generating boards at the other of the ends of said spaced opposed edges for hinging said boards to each other for folding about said axis and having means for draining water from the hollow interior of each of said air bubble generating boards.

7. An air bubble generating apparatus as claimed in claim 1 in which said air bubble generating boards each have an upper panel having a large number of bubble openings therein, a plurality of spacers on the lower surface thereof, and a side wall depending from the peripheral edge thereof, a lower panel secured to the lower edge of said side wall for defining a hollow interior within the board out of which said bubble openings open, and partition means partitioning off from said hollow interior an air space along said one edge of the board, said partition means having an aperture therethrough, and said air supplying means opening into said air spaces in the respective boards.

8. An air bubble generating apparatus as claimed in claim 7 in which the lower surface of said upper panel has a central passage therealong extending away from said partition means and with which said aperture is aligned, said bubble openings being at regular intervals in the portions of said upper panel other than that in which said central passage is located.

9. An air bubble generating apparatus as claimed in claim 8 in which said spacers are U-shaped spacers with the opening thereof facing toward said air space.

10. An air bubble generating apparatus as claimed in claim 7 in which said spacers are U-shaped spacers with the opening thereof facing toward said air space.

11. An air bubble generating apparatus as claimed in claim 1 further comprising supporters including rubber dampers on the lower surfaces of said air bubble generating boards.

* * * * *